US010840661B2

(12) United States Patent
Kossak

(10) Patent No.: US 10,840,661 B2
(45) Date of Patent: Nov. 17, 2020

(54) TERMINAL LOCATOR FOR CRIMPING TOOLS

(71) Applicant: Panduit Corp., Tinley Park, IL (US)

(72) Inventor: Robert W. Kossak, Lemont, IL (US)

(73) Assignee: Panduit Corp., Tinley Park, IL (US)

( * ) Notice: Subject to any disclaimer, the term of this patent is extended or adjusted under 35 U.S.C. 154(b) by 192 days.

(21) Appl. No.: 16/055,719

(22) Filed: Aug. 6, 2018

(65) Prior Publication Data

US 2019/0052041 A1 Feb. 14, 2019

Related U.S. Application Data

(60) Provisional application No. 62/543,066, filed on Aug. 9, 2017.

(51) Int. Cl.

| | |
|---|---|
| ***B25B 27/10*** | (2006.01) |
| ***H01R 43/042*** | (2006.01) |
| ***B25B 27/14*** | (2006.01) |
| ***H01R 43/048*** | (2006.01) |

(52) U.S. Cl.

CPC ..... *H01R 43/042* (2013.01); *B25B 27/10* (2013.01); *B25B 27/146* (2013.01); *H01R 43/048* (2013.01)

(58) Field of Classification Search

CPC .. H01R 43/042; H01R 43/045; H01R 43/048; H01R 43/55; Y10T 29/49185; Y10T 29/53226; Y10T 29/53235

See application file for complete search history.

(56) References Cited

U.S. PATENT DOCUMENTS

| | | | |
|---|---|---|---|
| 3,504,417 | A | 4/1970 | Filia |
| 3,931,671 | A | 1/1976 | Dittmann |
| 5,924,322 | A | 7/1999 | Caveney |
| 6,138,346 | A | 10/2000 | Shutts et al. |
| 6,155,095 | A | 12/2000 | Beetz |
| 6,718,870 | B1 | 4/2004 | Frenken |
| 7,254,982 | B2 | 8/2007 | Frenken |
| 7,412,868 | B2 | 8/2008 | Frenken |
| 8,074,485 | B2 | 12/2011 | College |
| 8,161,789 | B2 | 4/2012 | Battenfeld et al. |
| 8,601,856 | B2 | 12/2013 | Battenfeld |
| 8,839,653 | B2 | 9/2014 | Roman, Jr. et al. |
| 9,231,360 | B2 | 1/2016 | Smith |

(Continued)

FOREIGN PATENT DOCUMENTS

EP 0613220 A1 8/1994

OTHER PUBLICATIONS

Molex, Hand Crimp Tool Specification Sheet, Feb. 20, 2007 (Year: 2007).*

*Primary Examiner* — Matthew Katcoff

(74) *Attorney, Agent, or Firm* — Christopher S. Clancy; James H. Williams; Aimee E. McVady

(57) ABSTRACT

A terminal locator mounted to crimp dies in a crimp tool to aide in positioning electrical terminals in the tool. The terminal locator includes a mounting base secured to the tool. The mounting base includes a main body with a mounting hole to receive mounting hardware to secure the main body to the crimp tool. The terminal locator also includes a terminal locator body that is pivotally mounted to the mounting base. The terminal locator body rotates away from the crimp tool when the terminal locator is not required for positioning the terminal in the tool.

16 Claims, 14 Drawing Sheets

(56) References Cited

U.S. PATENT DOCUMENTS

| | | | |
|---|---|---|---|
| 9,413,129 | B2 | 8/2016 | Jonasson et al. |
| 9,484,700 | B2 | 11/2016 | Kehoe |
| 2011/0030447 | A1 | 2/2011 | Backenstoes et al. |

* cited by examiner

TERMINAL LOCATOR FOR CRIMPING TOOLS

CROSS REFERENCE TO RELATED APPLICATION

This application claims priority to U.S. Provisional Application No. 62/543,066, filed Aug. 9, 2017, the subject matter of which is hereby incorporated by reference in its entirety.

FIELD OF THE INVENTION

The present invention relates to crimping tools, and more particularly, to a terminal locator installed on a crimping tool.

BACKGROUND OF THE INVENTION

A wide variety of crimping tools have been used to crimp electrical terminals, disconnects, and splices. The terminals are generally the flat blade type, such as a ring or fork terminal, or of the female disconnect type having outer walls curled inside to define an opening for receiving a flat male tab. It has been known to use a terminal locator on a crimping tool for properly aligning the barrel portion of a flat blade terminal connector with the crimp dies. Prior locators include a narrow slot sized so the flat end portion of the terminal passes through the slot and the locator acts as a stop to the barrel portion to properly align the barrel for crimping. The locator also acts as a wire stop for these flat blade terminals. The locators, however, are designed to be used only with a specific size or type of terminal. When the locator is not required for positioning a specific terminal, the locator needs to be moved out of position or removed to enable the tool to crimp those terminals.

Thus, there is a need for an improved terminal locator that accommodates multiple sized terminals. There is also a need for an improved terminal locator that rotates out of position away from the crimp tool when the terminal locator is not required.

SUMMARY OF THE INVENTION

A terminal locator secured to a crimp tool to align a terminal in the crimp tool. The terminal locator includes a mounting base and a terminal locator body. The terminal locator body is pivotally attached to the mounting base. The main body of the mounting base includes a mounting hole to receive mounting hardware to secure the main body to the crimp tool. The pivotally mounted terminal locator body rotates away from the mounting base and the crimp tool when the terminal locator body is not required to align the terminal in the crimp tool.

DETAILED DESCRIPTION

The terminal locator of the present invention enables the end user to properly position various sizes and types of wire terminals for crimping in a crimp tool. The terminal locator is designed to be installed on the crimp tool illustrated or other similar crimp tools. As described below, the terminal locator of the present invention may be rotated away from the tool when the end user does not require a terminal locator to aid in positioning a terminal in the tool. As such, when the terminal locator is not required, it does not need to be removed. It is conveniently rotated away from the tool.

Figure 1:
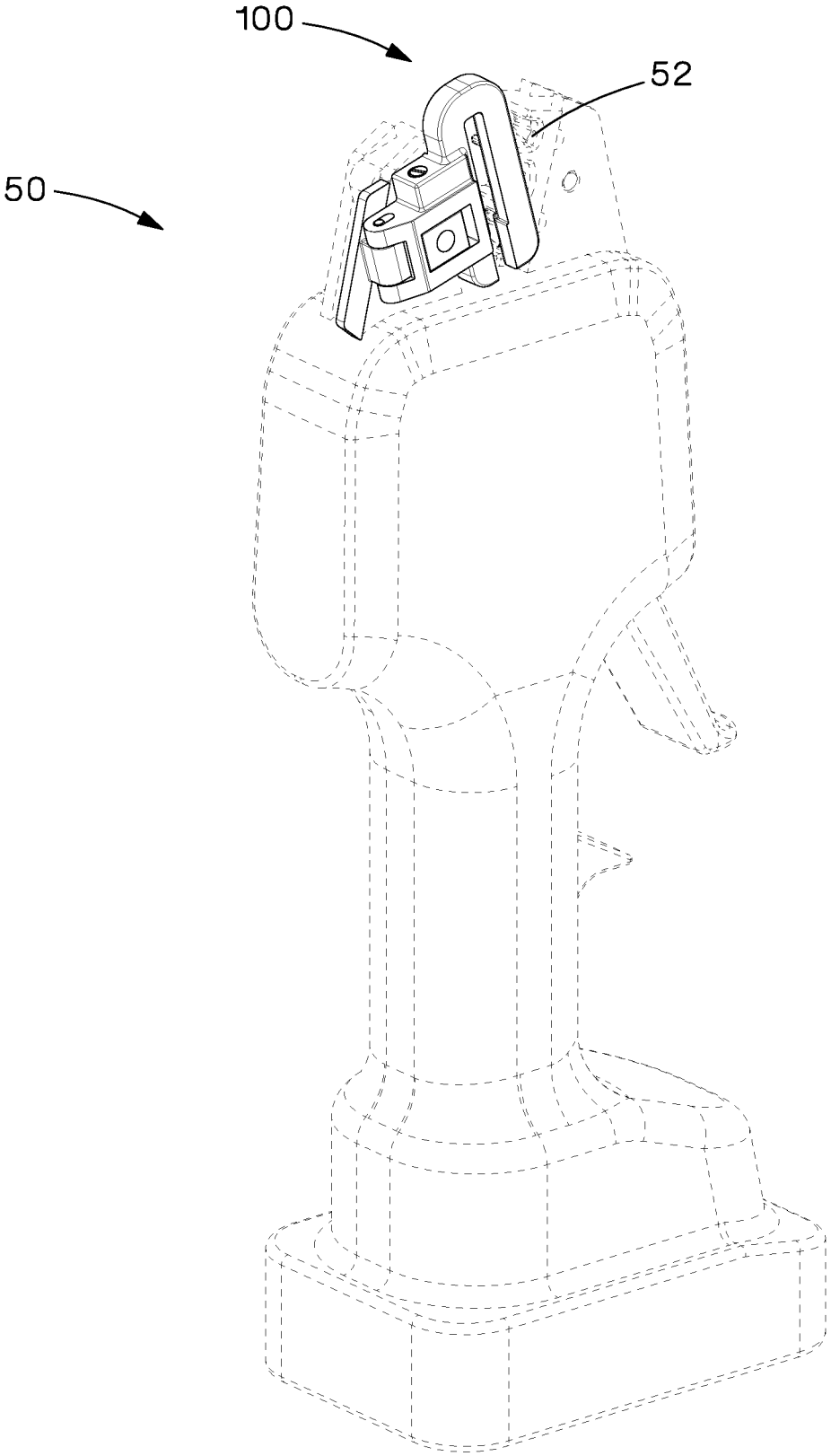
FIG. 1 is a perspective view of the terminal locator of the present invention installed on a crimp tool.
Figure 2:
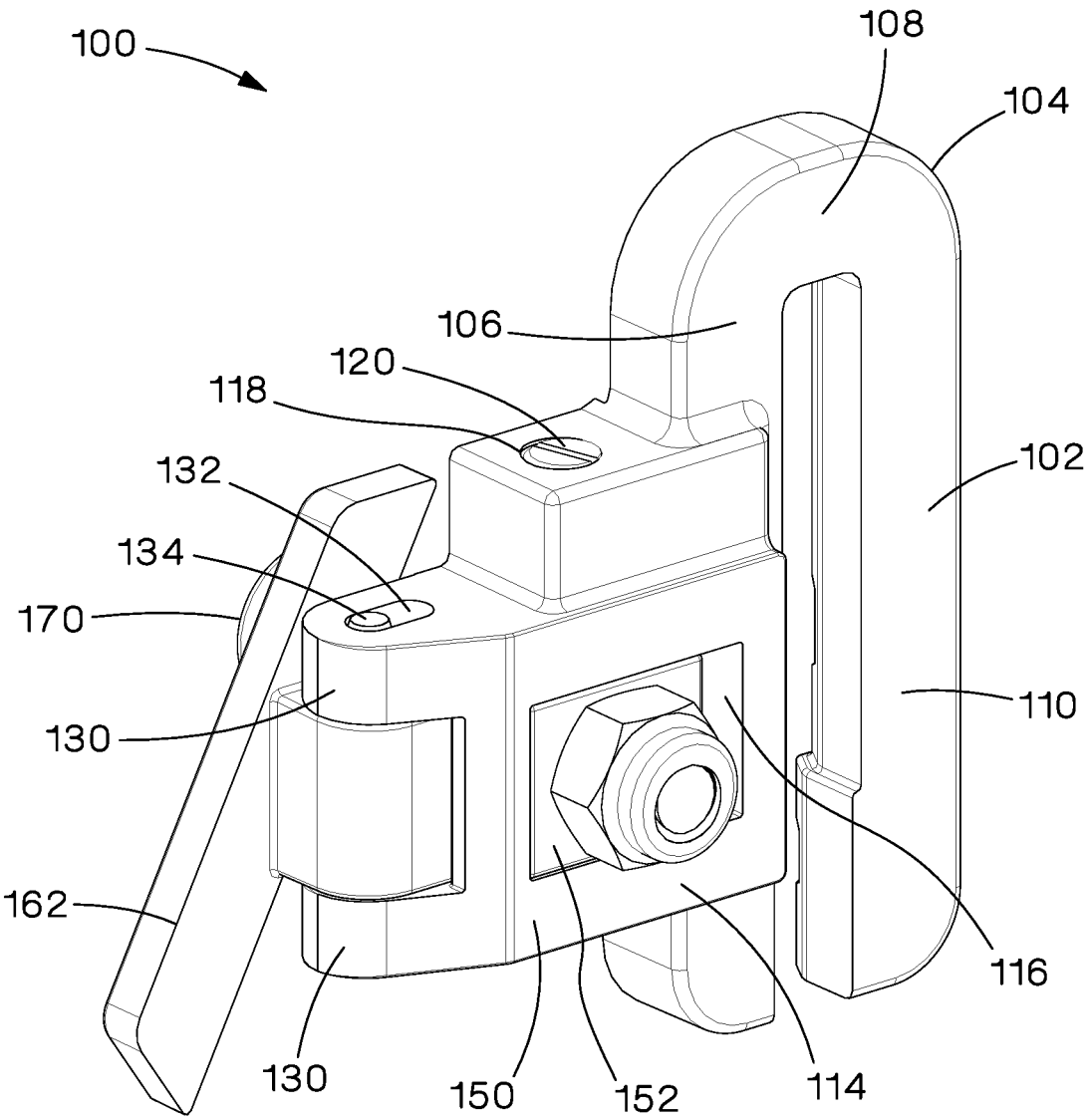
FIG. 2 is a perspective view of the terminal locator of FIG. 1.
Figure 3:
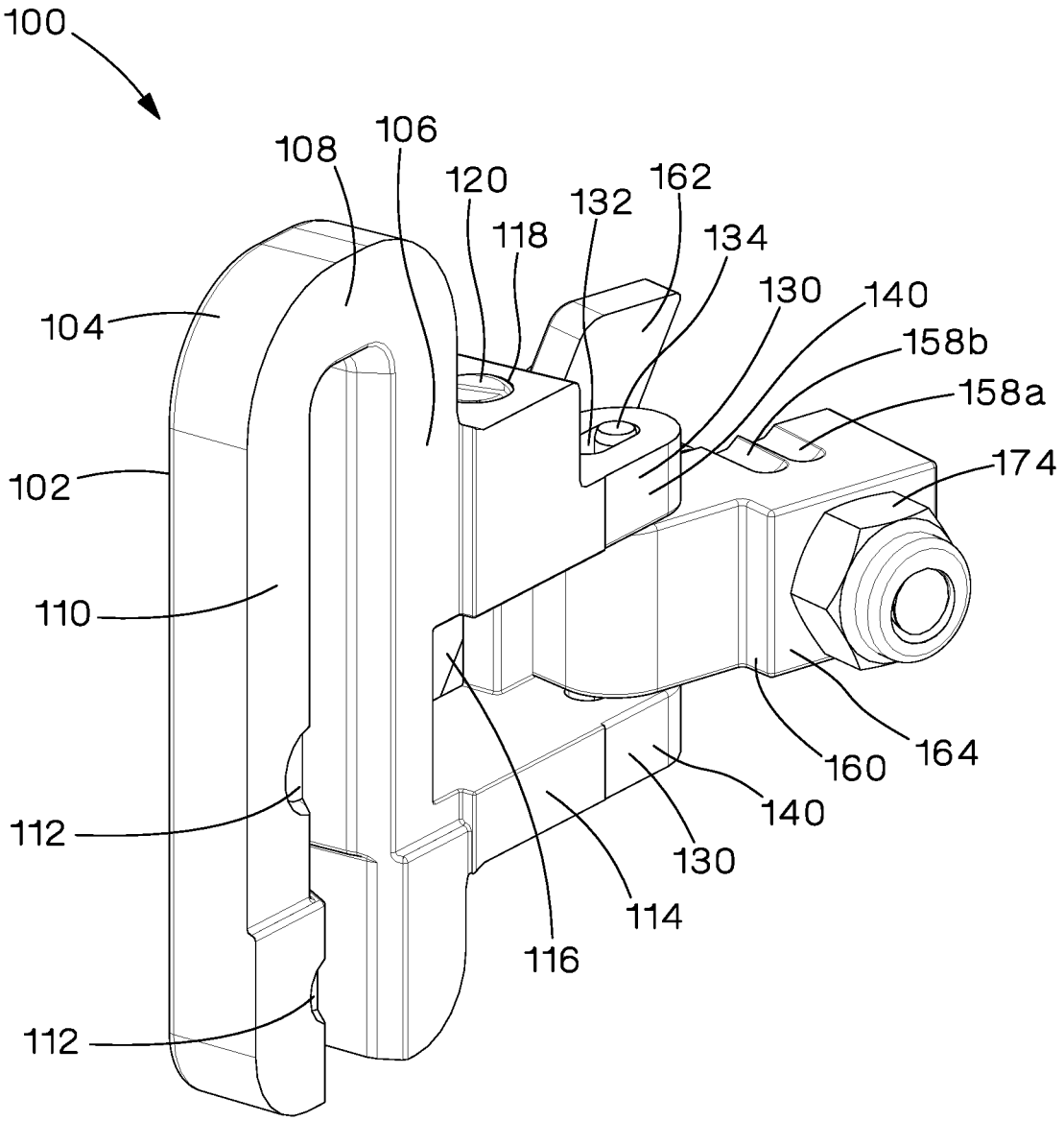
FIG. 3 is a perspective view of the terminal locator of FIG. 2 rotated to an open position.
Figure 4:
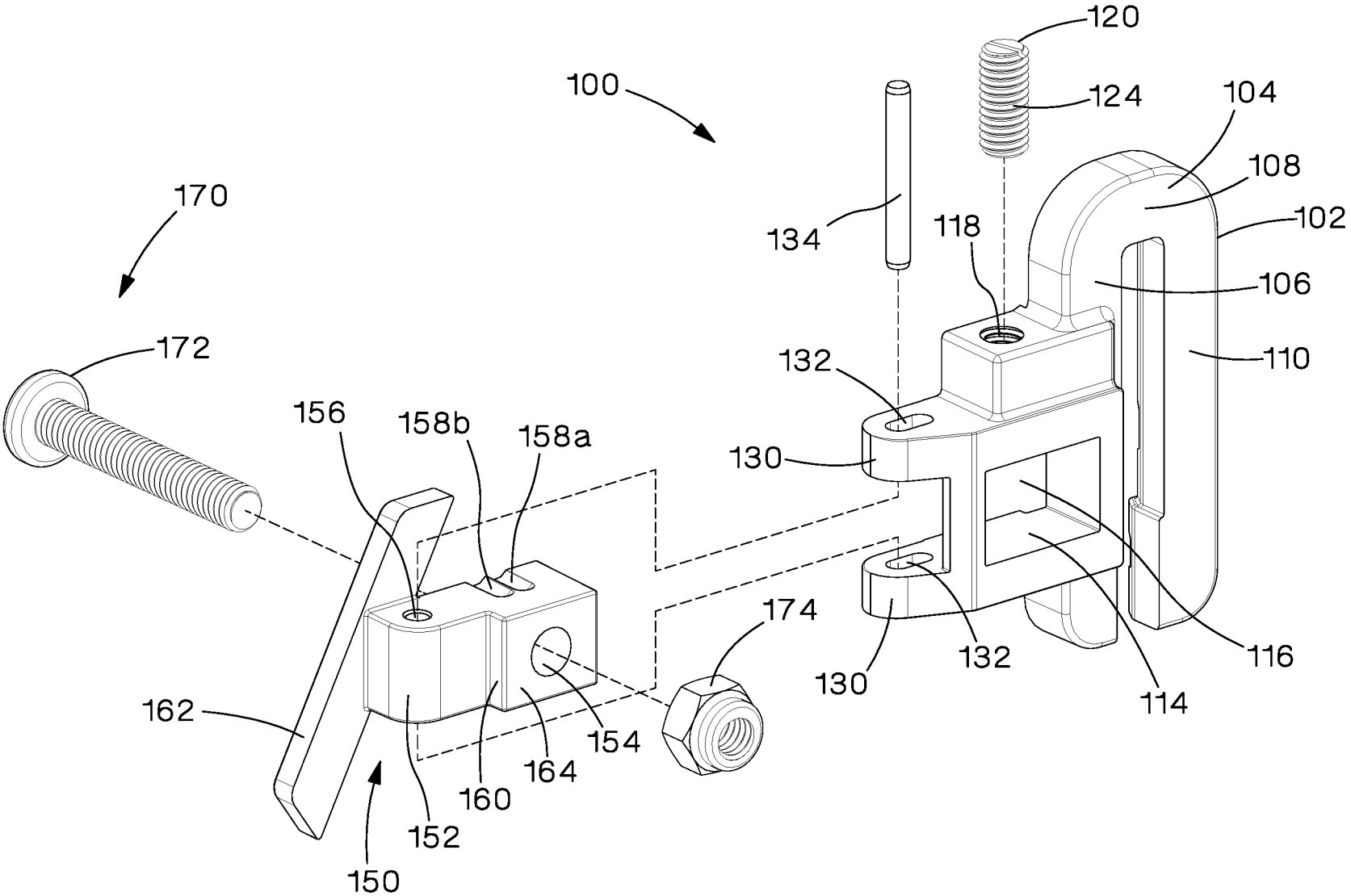
FIG. 4 is an exploded view of the terminal locator of FIG. 2.

FIG. 1 illustrates the terminal locator 100 installed on a battery powered crimp tool 50. As illustrated in FIGS. 2-4, the terminal locator 100 includes a terminal locator body 102, a mounting base 150, and mounting hardware 170 to secure the terminal locator 100 to the crimp tool 50. The terminal locator body 102 is pivotally attached to the mounting base 150 thereby allowing the terminal locator body 102 to swing away from the mounting base 150 (see FIG. 3).

Figure 5:
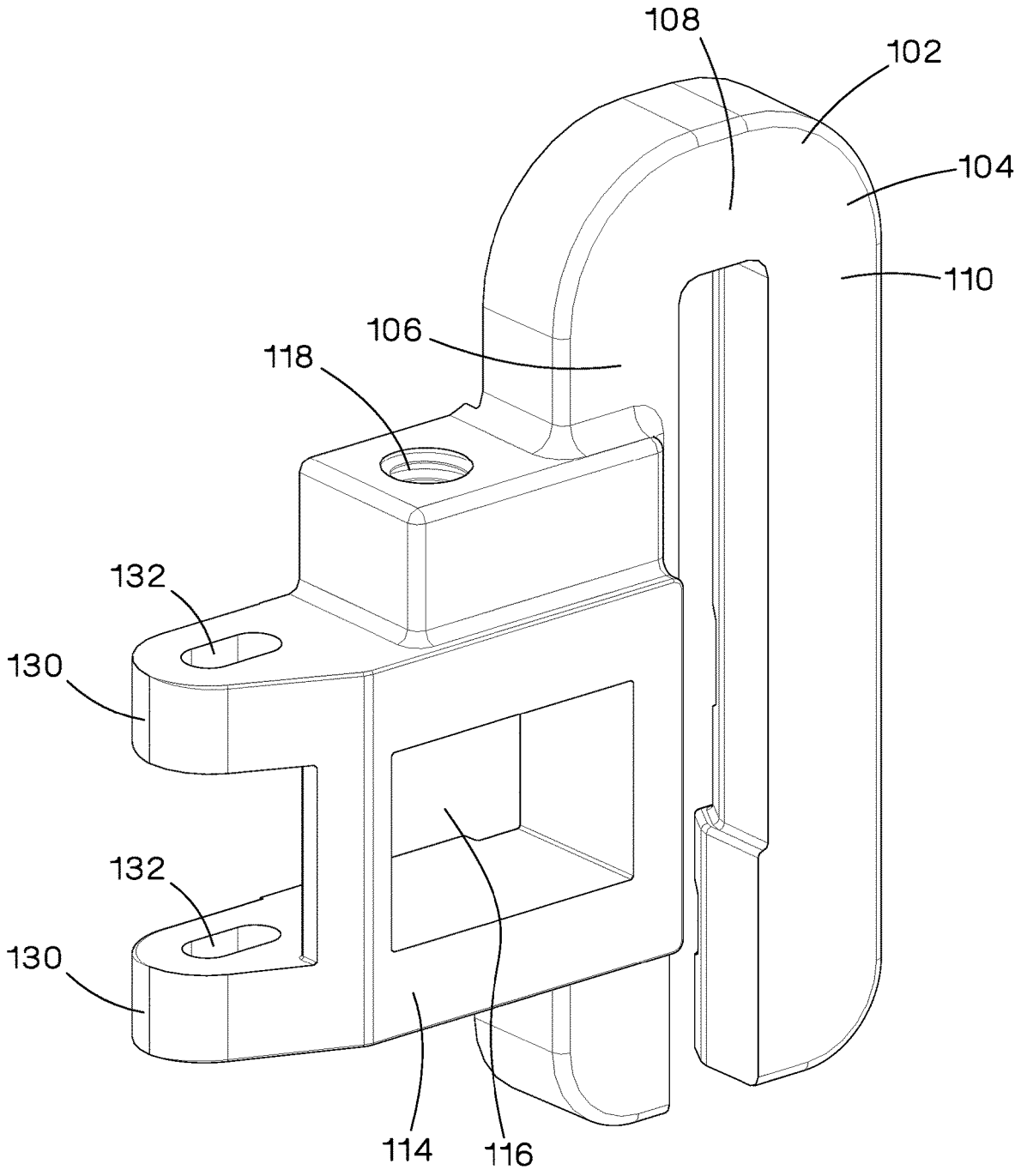
FIG. 5 is a front perspective view of the terminal locator body of the terminal locator of FIG. 2.
Figure 6:
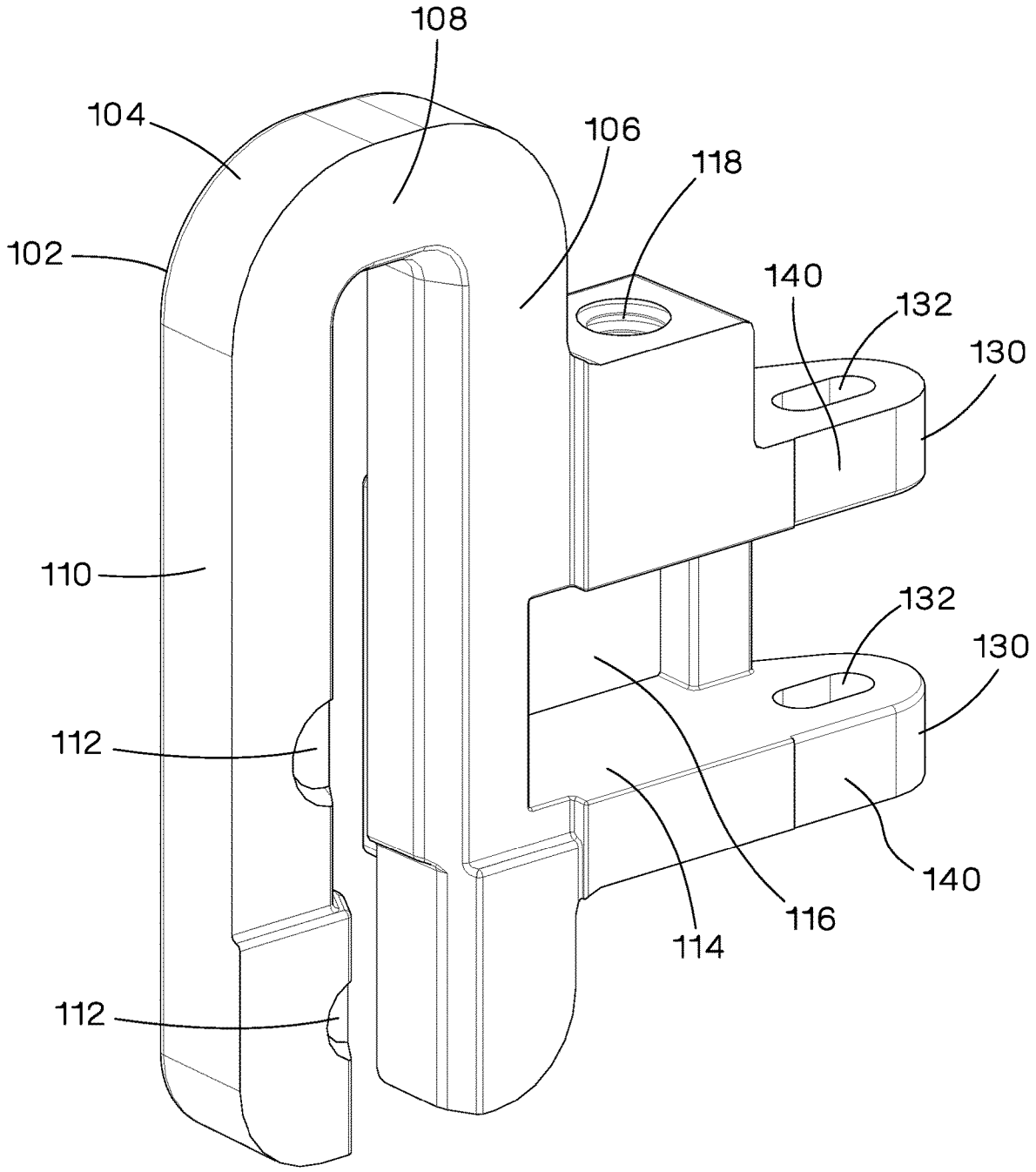
FIG. 6 is a rear perspective view of the terminal locator body of FIG. 5.

As illustrated in FIGS. 4-6, the terminal locator body 102 includes a reversed U-shaped frame 104 and a guide portion 114. The reversed U-shaped frame 104 locates the terminals to be crimped in proper orientation. As illustrated in FIG. 6, the reversed U-shaped frame 104 includes an attaching beam 106, a joining member 108, and a locating beam 110. The attaching beam 106 is adjacent the guide portion 114 that receives the mounting base 150. The joining member 108 connects the attaching beam 106 to the locating beam 110. The locating beam 110 has two shallow semicircular recesses 112 or pockets that accommodate the ends of electrical wires extending past the terminal barrel ends. The recesses 112 stop the wires so that the crimp is not being made on the very end of the wire. Each of the recesses 112 corresponds to a particular crimp pocket 54 in the crimp die 52 inserted into the crimp tool 50.

The guide portion 114 includes a guide window 116, threaded hole 118, and two hinge projections 130 with travel limiting slots 132. The pivot shaft 134 is positioned in the travel limiting slots 132 of the hinge projections 130. The pivot shaft 134 slides within the travel limiting slots 132 between a first position and a second position (see FIGS. 16 and 17).

As illustrated in FIG. 2, the guide window 116 receives the main body 152 and the mounting pad 164 of the mounting base 150.

Figure 16:
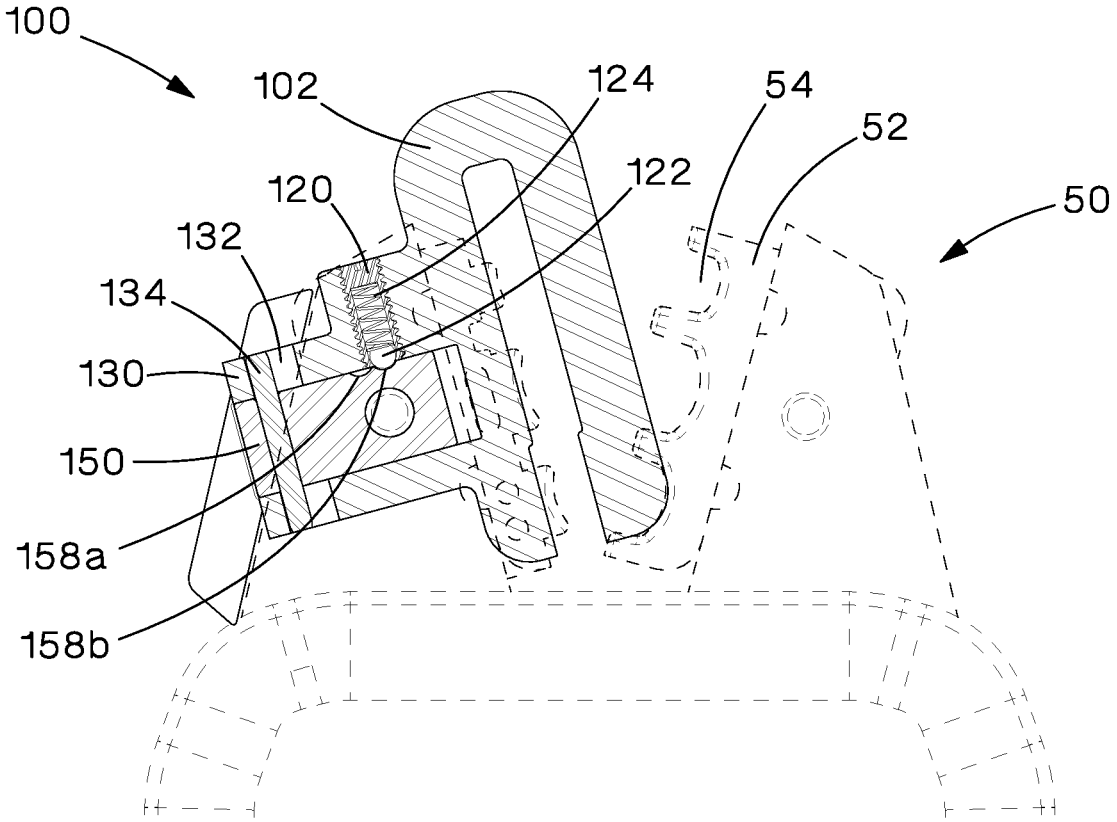
FIG. 16 is a cross sectional view of the terminal locator of FIG. 13 installed on the crimp tool and positioned with a wide crimping space.
Figure 17:
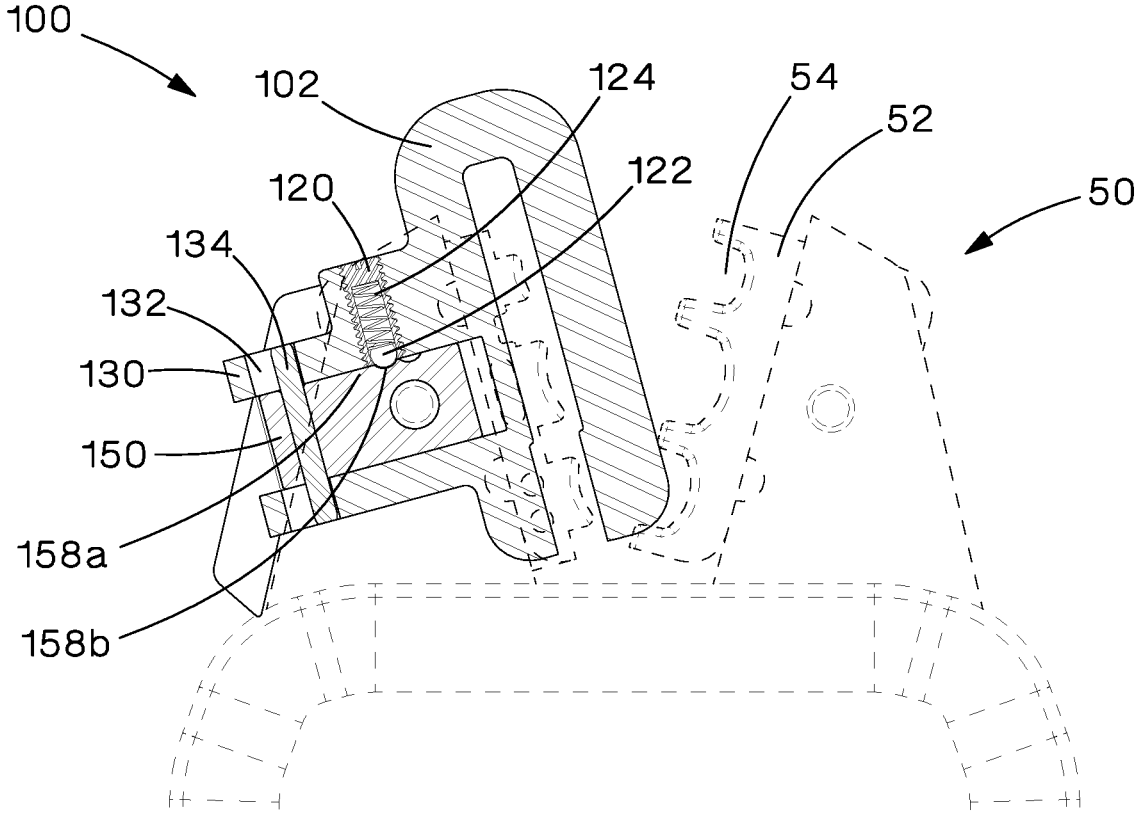
FIG. 17 is a cross sectional view of the terminal locator of FIG. 15 installed on the crimp tool and positioned with a narrow crimping space.

The threaded hole 118 of the guide portion 114 accommodates a spring-loaded plunger 120 that serves as a detent retaining the terminal locator body 102 in either the first position or the second position (see FIGS. 16-17). As illustrated in FIGS. 16-17, the spring-loaded plunger 120 includes a ball 122 at the distal end and a spring 124 located inside the body of the plunger 120. As discussed below, the travel limiting slots 132 allow the terminal locator body 102 to slide between the two positions. The travel limiting slots 132 also enable the terminal locator body 102 to be positioned to pivot away from the crimp tool 50.

The terminal locator body 102 also includes back reliefs 140. The back reliefs 140 on the hinge projections 130 provide clearance to avoid interference with the positioning flange 162 of the locator mounting base 150 while the locator main body 102 is being rotated away.

Figure 7:
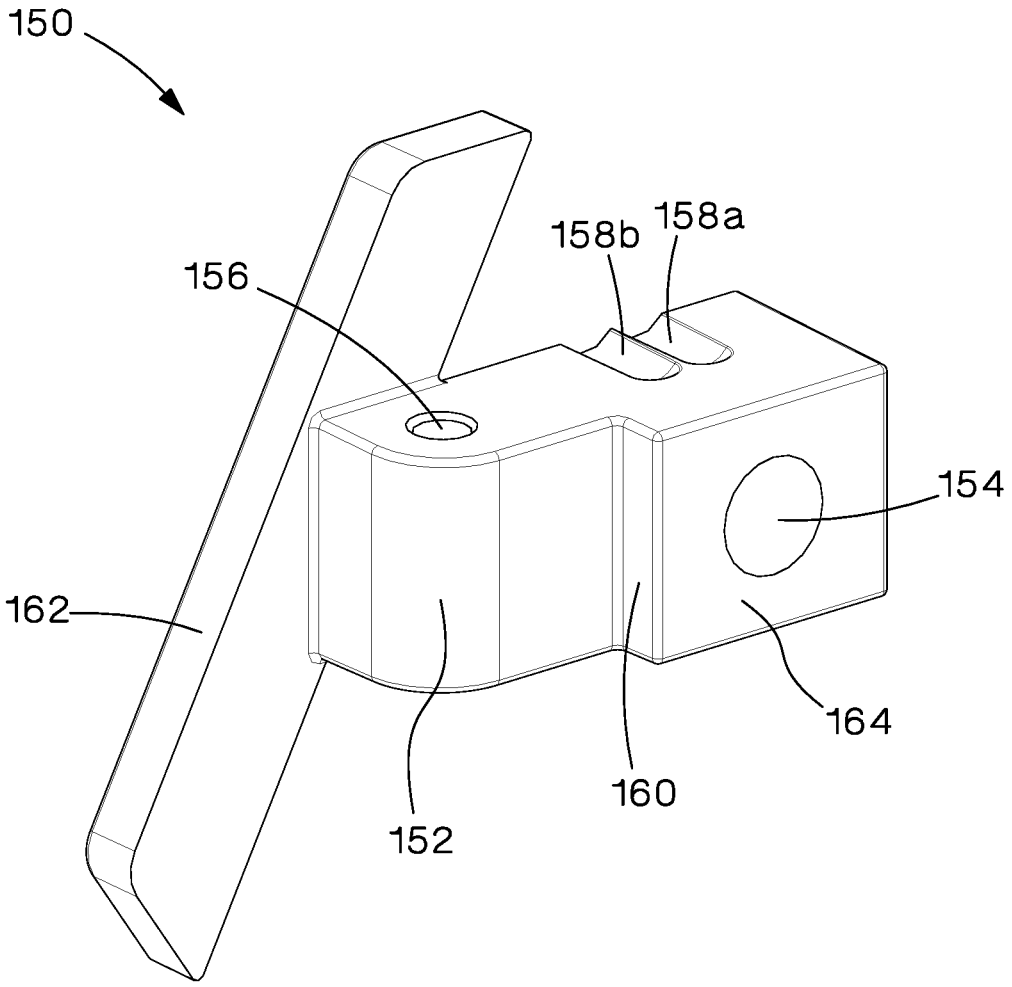
FIG. 7 is a front perspective view of the mounting base of the terminal locator of FIG. 2.
Figure 8:
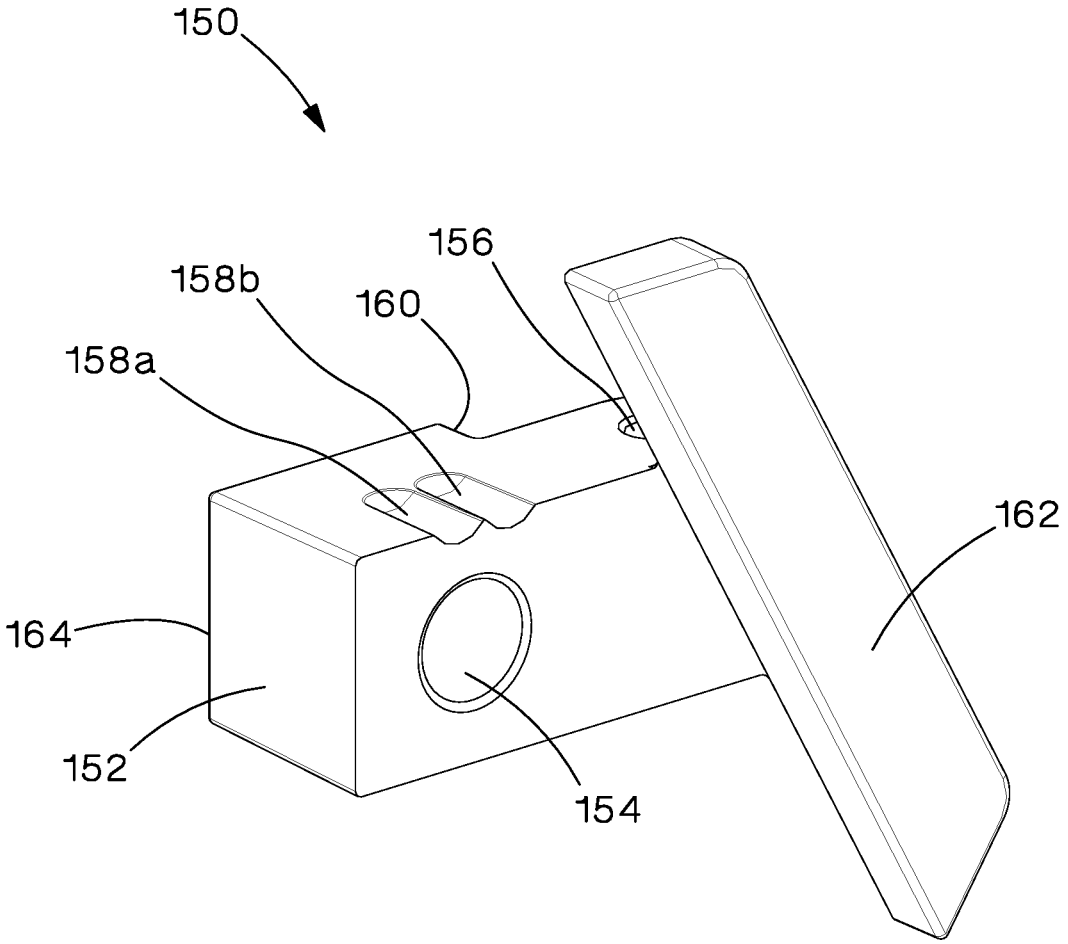
FIG. 8 is a rear perspective view of the mounting base of FIG. 7.

FIGS. 4, 7, and 8 illustrate the mounting base 150. The mounting base 150 includes a main body 152, a positioning flange 162, and a mount pad 164. The positioning flange 162 sets the mounting base 150 against the edge of the crimp tool jaw and prevents accidental rotation of the crimp tool jaw. The main body 152 has a mounting hole 154 that receives the mounting hardware 170 and a pivot shaft hole 156 that accommodates the pivot shaft 134. The main body 152 also includes two detent slots 158*a*, 158*b* that accommodate the ball 122 of the spring-loaded plunger 120 and a raised projection 160 that serves as a mounting pad 164.

As illustrated in FIG. 4, the mounting hardware 170 for the terminal locator 100 includes a mounting screw 172 and a hex lock nut 174. The mounting screw 172 is inserted through the crimp tool 50 and the mounting hole 154 of the main body 152 to mount the terminal locator 100 to the crimp tool 50. The hex lock nut 174 secures the mounting screw 172 once it is installed through the mounting hole 154. Since the mounting screw 172 passes through the main body 152 and the mounting pad 164, the hex lock nut 174 of the mounting hardware 170 rests on the mounting pad 164.

Figure 9:
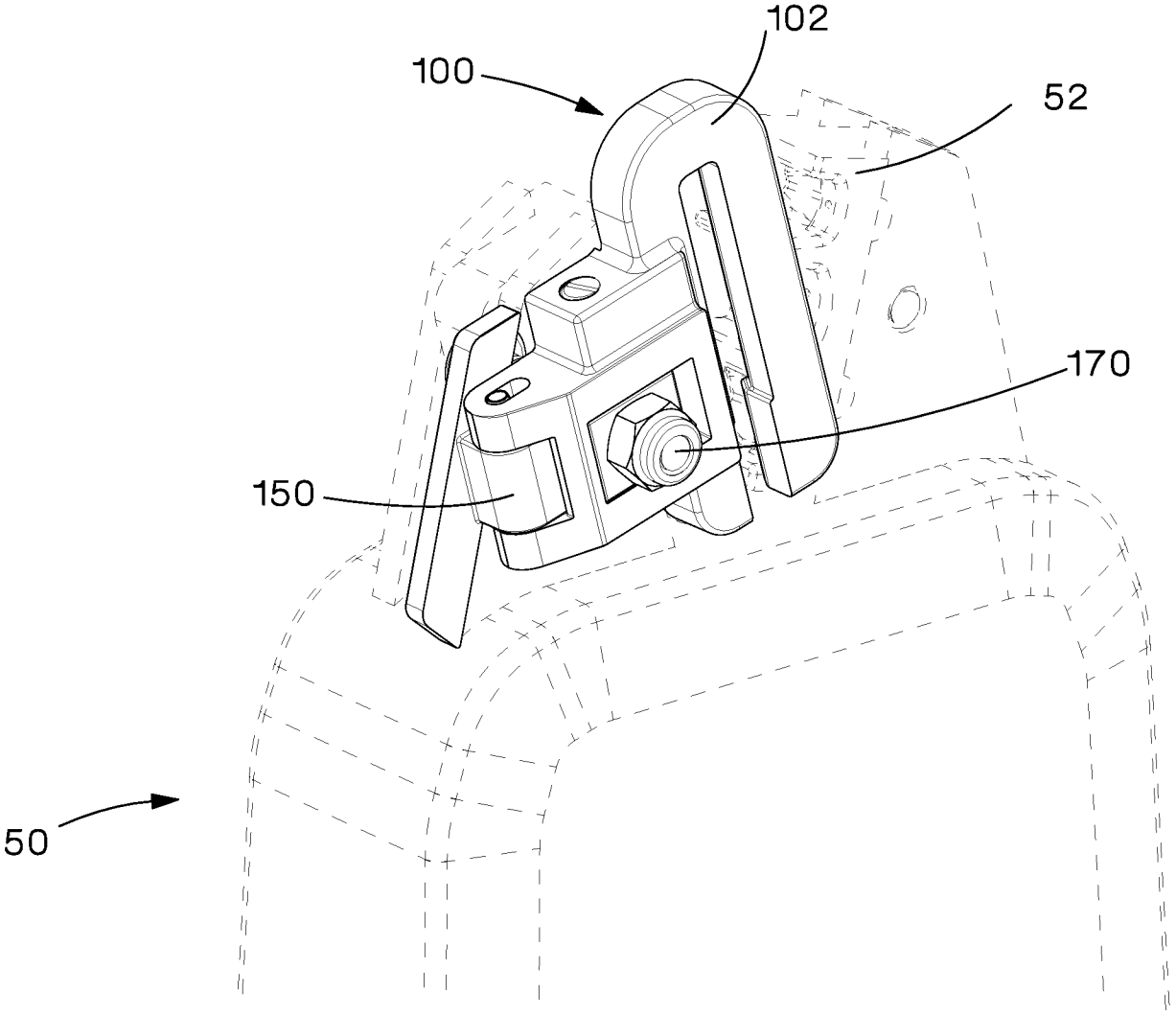
FIG. 9 is a perspective view of the terminal locator of FIG. 2 installed on a crimp tool.
Figure 10:
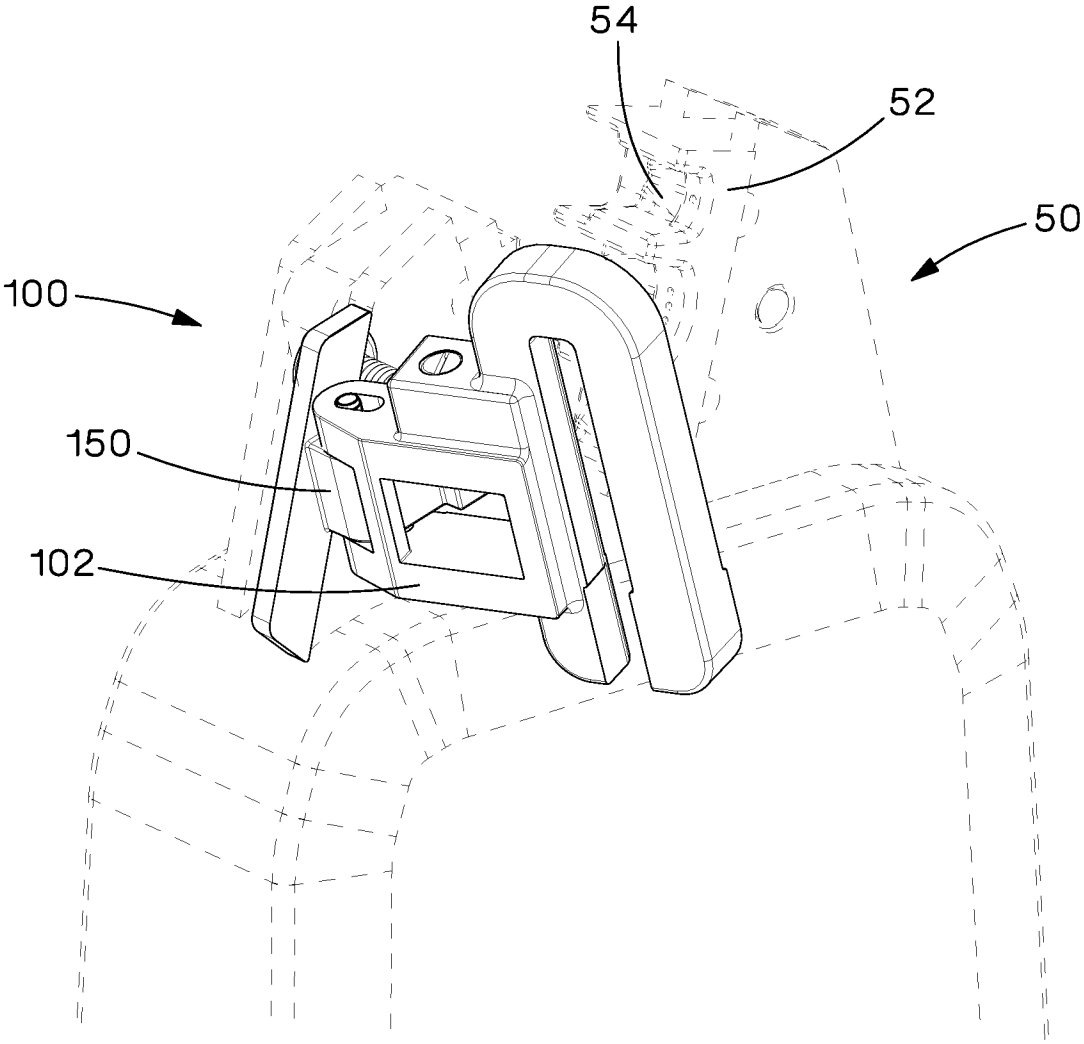
FIG. 10 is a perspective view of the terminal locator of FIG. 9 partially rotated away from the crimp tool.
Figure 11:
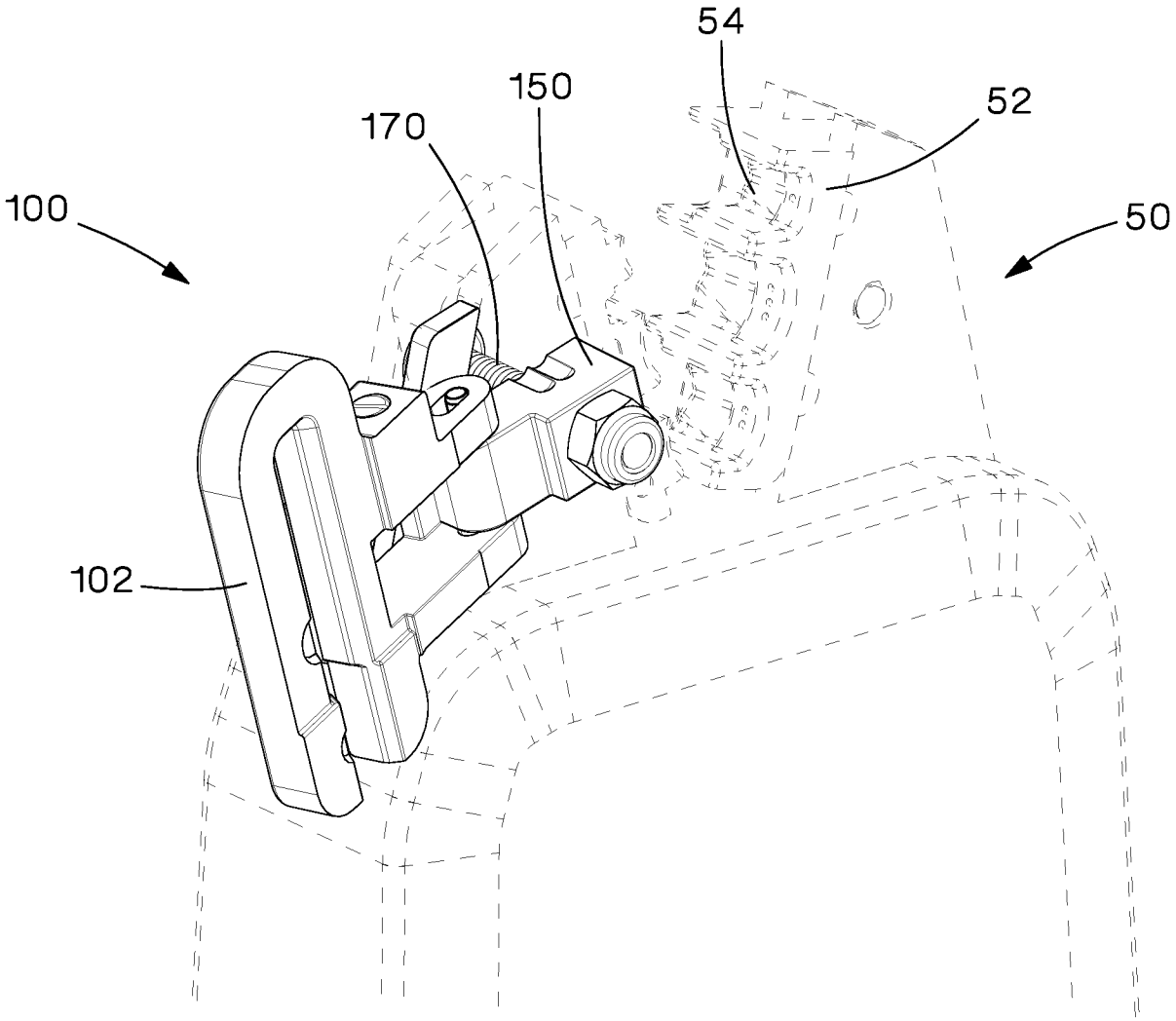
FIG. 11 is a perspective view of the terminal locator of FIG. 9 fully rotated away from the crimp tool.

FIGS. 9-17 illustrate the terminal locator 100 of the present invention installed on a crimp tool. FIG. 9 illustrates the terminal locator 100 secured to the crimp tool 50 ready to receive and position a terminal. As discussed above, if the terminal to be crimp does not require the terminal locator 100, the end user simply rotates the terminal locator body 102 away from the crimp tool 50. In order to rotate the terminal locator body 102, the pivot shaft 134 must be positioned in the first position of the travel limiting slots 132, that is, the terminal locator body must be closest to the crimp die 52. FIG. 10 illustrates the terminal locator 100 partially rotated away from the crimp tool 50. FIG. 11 illustrates the terminal locator 100 fully rotated away from the crimp tool 50. In this position, the terminal locator 100 is out of the way. The end user may now use the crimp tool 50 to crimp a terminal without the terminal locator 100.

Figure 12:
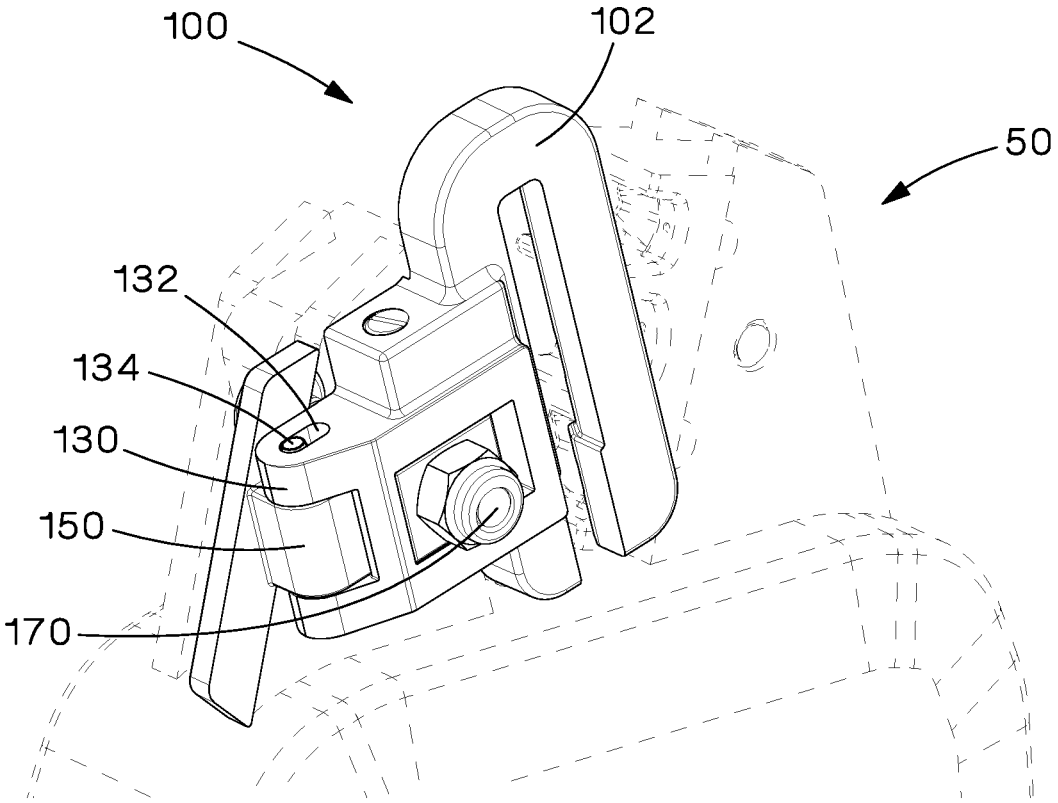
FIG. 12 is a perspective view of the terminal locator of the present invention installed on a crimp tool and positioned with a wide crimping space.
Figure 13:
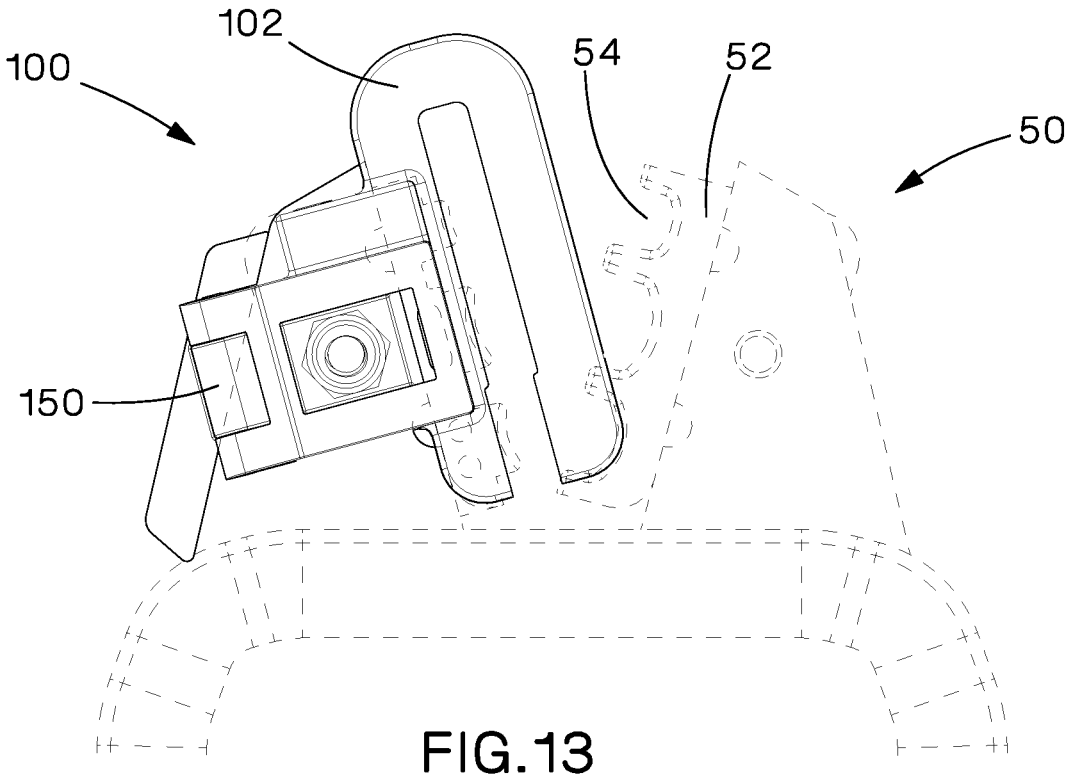
FIG. 13 is a front view of the terminal locator of FIG. 12 installed on the crimp tool and positioned with a wide crimping space.

FIGS. 12-17 illustrate the crimp tool 50 with the terminal locator 100 installed in the first position and the second position for positioning various terminals to be crimped. FIGS. 12-13 and 16 illustrate the terminal locator 100 installed on the crimp tool 50 in a first position. The terminal locator body 102 is pushed manually inward, toward the crimp die opening, to increase the space between the crimp die 52 and the locating beam 110 of the reversed U-shape frame 104. The space between the crimp die 52 and the locating beam 110 receives disconnects or terminals with thick tongues. As illustrated in FIG. 16, in this position the ball 122 of the spring-loaded plunger 120 is located in the first detent slot 158*a* of the main body 152.

Figure 14:
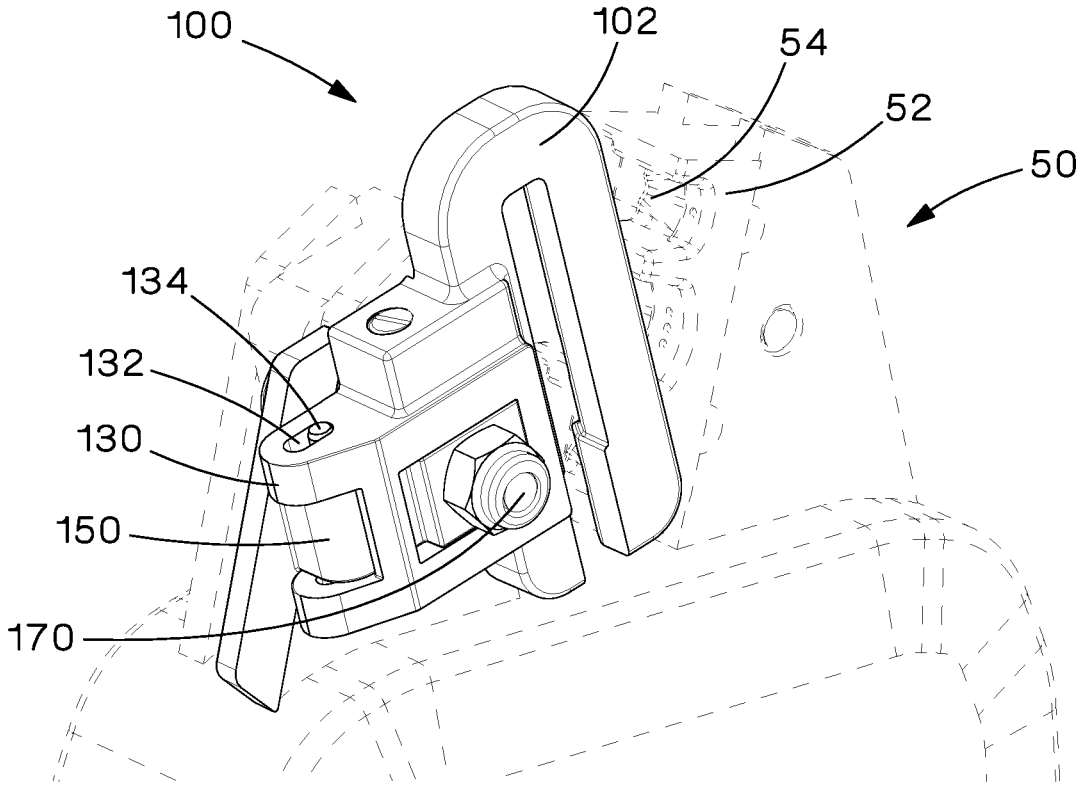
FIG. 14 is a perspective view of the terminal locator of the present invention installed on crimp tool and positioned with a narrow crimping space.
Figure 15:
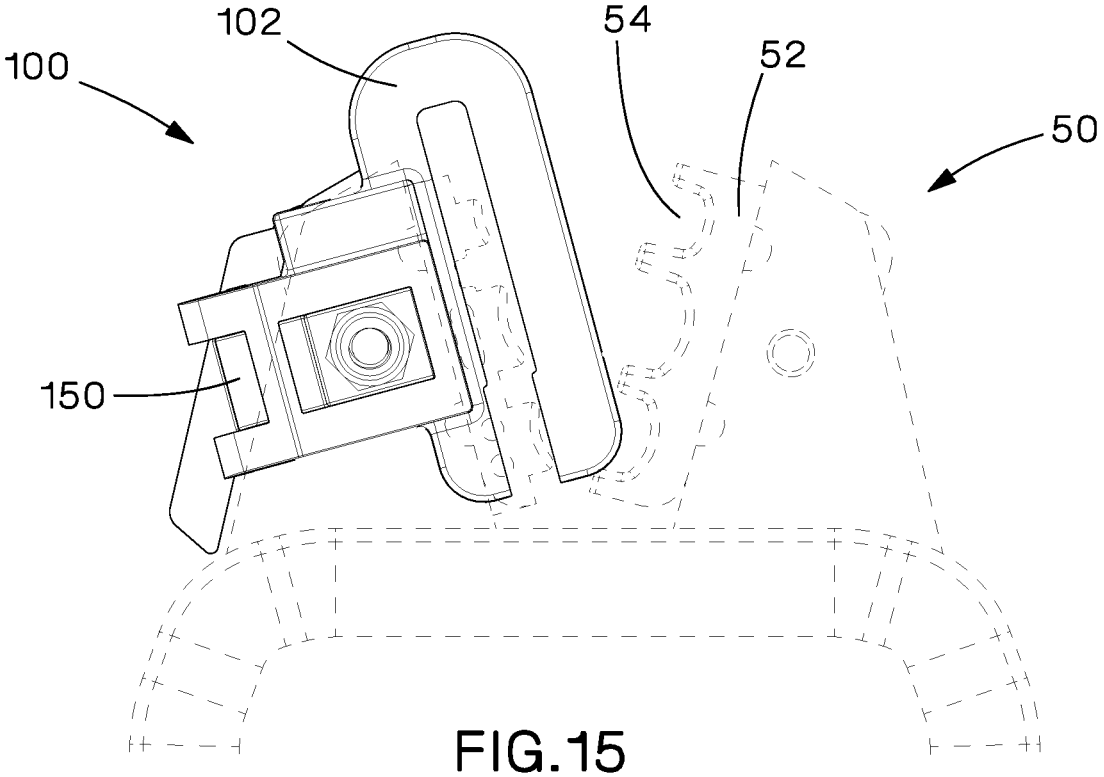
FIG. 15 is a front view of the terminal locator of FIG. 14 installed on the crimp tool and positioned with a narrow crimping space.

FIGS. 14-15 and 17 illustrate the terminal locator 100 installed on the crimp tool 50 in a second position. The terminal locator body 102 is pushed manually outward, away from the crimp die opening, to decrease the space between the crimp die 52 and the locating beam 110 of the reversed U-shape frame 104. The crimp die opening receives terminals with thin tongues. As illustrated in FIG. 17, the ball 122 of the spring-loaded plunger 120 is located in the second detent slot 158*b* of the main body 152.

Thus, as discussed above, the terminal locator of the present invention accommodates multiple sized terminals. The terminal locator also conveniently rotates away from the crimp tool to enable the crimp tool to crimp terminals when a locator is not required.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A terminal locator for aligning a terminal in a crimp tool, the terminal locator comprising:

a mounting base having a main body with a mounting hole for receiving mounting hardware to secure the main body to the crimp tool;

a terminal locator body pivotally attached to the mounting base;

wherein the terminal locator body includes a U-shaped frame for positioning the terminal to be crimped and a guide portion that receives the mounting base, wherein the guide portion includes a guide window and parallel hinge projections having aligned slots;

wherein a pivot shaft is positioned in the slots, whereby the pivot shaft slides within the slots moving the terminal locator body from a first position to a second position;

whereby the terminal locator body rotates away from the mounting base and the crimp tool.

2. The terminal locator of claim 1, wherein the U-shaped frame includes an attaching beam, a joining member and a locating beam;

wherein the attaching beam is positioned adjacent the guide portion; and wherein the joining member links the attaching beam to the locating beam.

3. The terminal locator of claim 2, wherein the locating beam has two recesses for accommodating ends of electrical wires extending past the terminal.

4. The terminal locator of claim 1, wherein the main body has pivot shaft hole for receiving the pivot shaft to secure the mounting base to the guide portion of the terminal locator body.

5. The terminal locator of claim 1, wherein the guide portion further comprising a threaded hole and a plunger positioned therein; wherein the plunger retains the terminal locator body in one of a first position or a second position.

6. The terminal locator of claim 5, wherein the plunger is spring loaded with a ball at a distal end and a spring located inside a body of the plunger.

7. The terminal locator of claim 1, wherein the mounting base further comprising a positioning flange and a raised projection that forms a mount pad.

8. The terminal locator of claim 7, wherein the positioning flange locates the mounting base against an edge of a crimp tool jaw of the crimping tool to prevent rotation of the crimp tool jaw.

9. The terminal locator of claim 1, wherein the main body has pivot shaft hole for receiving a pivot shaft to secure the mounting base to the guide portion of the terminal locator body.

10. A terminal locator mounted to crimp dies in a crimp tool for positioning electrical terminals in the crimp tool, the terminal locator comprising:

a mounting base secured to the crimp tool;

a terminal locator body pivotally mounted to the mounting base;

wherein the terminal locator body includes a U-shaped frame for positioning the terminal to be crimped and a guide portion that receives the mounting base, wherein the guide portion includes a guide window and parallel hinge projections having aligned slots;

wherein a pivot shaft is positioned in the slots, whereby the pivot shaft slides within the slots moving the terminal locator body from a first position to a second position;

wherein the mounting base has a main body with a pivot shaft hole for receiving the pivot shaft to secure the mounting base to the guide portion of the terminal locator body; and whereby the terminal locator body rotates away from the crimp tool when the terminal locator is not required for positioning the terminal in the crimp tool.

11. The terminal locator of claim 10, wherein the mounting base includes a main body, a positioning flange, and a raised projection that forms a mount pad; wherein the main body includes a mounting hole for receiving mounting hardware to secure the main body to the crimp tool.

12. The terminal locator of claim 11, wherein the positioning flange locates the mounting base against an edge of a crimp tool jaw to prevent rotation of the crimp tool jaw.

13. The terminal locator of claim 10, wherein the U-shaped frame includes an attaching beam, a joining member and a locating beam;

wherein the attaching beam is positioned adjacent the guide portion;

wherein the joining member links the attaching beam to the locating beam; and wherein the locating beam has two recesses for accommodating ends of electrical wires extending past the terminal.

14. The terminal locator of claim 10, wherein the guide portion further comprising a threaded hole and a plunger positioned therein, the plunger retaining the terminal locator body in one of the first position or the second position; and wherein the plunger is spring loaded with a ball at a distal end and a spring located inside a body of the plunger.

15. A terminal locator for aligning a terminal in a crimp tool, the terminal locator comprising:

a mounting base having a main body with a mounting hole for receiving mounting hardware to secure the main body to the crimp tool;

a terminal locator body pivotally attached to the mounting base; wherein the terminal locator body includes a U-shaped frame for positioning the terminal to be crimped and a guide portion that receives the mounting base;

wherein the guide portion includes a threaded hole and a plunger positioned therein; wherein the plunger retains the terminal locator body in one of a first position or a second position; and whereby the terminal locator body rotates away from the mounting base and the crimp tool.

16. The terminal locator of claim 15, wherein the plunger is spring loaded with a ball at a distal end and a spring located inside a body of the plunger.

* * * * *